US008007273B2

(12) United States Patent
Ruck et al.

(10) Patent No.: US 8,007,273 B2
(45) Date of Patent: Aug. 30, 2011

(54) PREMIXING BURNER FOR GENERATING AN IGNITABLE FUEL/AIR MIXTURE

(75) Inventors: Thomas Ruck, Rekingen (CH); Slawomir Slowik, Stetten (CH); Christian Steinbach, Birmenstorf (CH); Martin Andrea Von Planta, Oettwil a.d.L. (CH)

(73) Assignee: ALSTOM Technology Ltd., Baden (CH)

( * ) Notice: Subject to any disclaimer, the term of this patent is extended or adjusted under 35 U.S.C. 154(b) by 491 days.

(21) Appl. No.: 11/838,999

(22) Filed: Aug. 15, 2007

(65) Prior Publication Data

US 2008/0032246 A1 Feb. 7, 2008

Related U.S. Application Data

(63) Continuation of application No. PCT/EP2006/060355, filed on Mar. 1, 2006.

(30) Foreign Application Priority Data

Mar. 9, 2005 (CH) ..... 0407/05

(51) Int. Cl.
*F23M 3/00* (2006.01)

(52) U.S. Cl. ..... 431/9; 60/747; 60/737; 431/8

(58) Field of Classification Search ..... 431/8, 9, 431/154, 159, 181–184, 186, 189, 354; 60/722, 60/737, 746, 748, 747

See application file for complete search history.

(56) References Cited

U.S. PATENT DOCUMENTS 2,056,531 A * 10/1936 Morton ..... 432/20
2,181,108 A * 11/1939 Przyborowski ..... 29/727
2,390,947 A * 12/1945 Koci ..... 60/529
2,532,569 A * 12/1950 Poole et al. ..... 99/333
2,996,598 A * 8/1961 Barnes et al. ..... 219/454.12
3,324,625 A * 6/1967 Dulmage ..... 53/442
4,216,652 A * 8/1980 Herman et al. ..... 60/748
4,781,030 A * 11/1988 Hellat et al. ..... 60/743

(Continued)

FOREIGN PATENT DOCUMENTS

EP 0210462 2/1987

(Continued)

OTHER PUBLICATIONS

Search Report for Swiss Patent App. No. 00407/05 (Jul. 4, 2005).
International Search Report for PCT Patent App. No. PCT/EP2006/060355 (Jun. 16, 2006).

*Primary Examiner* — Steven B McAllister
*Assistant Examiner* — Desmond C Peyton
(74) *Attorney, Agent, or Firm* — Cermak Nakajima LLP; Adam J. Cermak

(57) ABSTRACT

A premixing burner has a swirl generator with at least two burner shells (1) which jointly enclose an axia conically widening swirl space and delimit tangential air inlet slits (3) through which combustion supply air passes into the swirl space in which an axially propagating swirl flow is formed, and with fuel injection devices at least partially along the tangentially running air inlet slits (3). The fuel injection devices include a fuel line (6) separate from the burner shell (1) and which is firmly attached to the burner shell (1) so as to be longitudinally movable with respect to the burner shell (1) and releasable perpendicularly to the surface of the burner shell (1). In the burner shell (1), orifices (4) are provided, into which issue fuel injectors (7) which are provided along the fuel line (6) and which project beyond the circumferential edge of the fuel line (6).

7 Claims, 4 Drawing Sheets

U.S. PATENT DOCUMENTS

| | | | | |
|---|---|---|---|---|
| 5,244,380 | A * | 9/1993 | Dobbeling et al. | 431/8 |
| 5,307,634 | A * | 5/1994 | Hu | 60/737 |
| 5,479,773 | A * | 1/1996 | McCoomb et al. | 60/800 |
| 5,482,457 | A * | 1/1996 | Aigner et al. | 431/351 |
| 5,916,142 | A * | 6/1999 | Snyder et al. | 60/748 |
| 5,980,240 | A | 11/1999 | Krautzig et al. | |
| 6,155,820 | A * | 12/2000 | Dobbeling et al. | 431/350 |
| 6,513,329 | B1 | 2/2003 | Snyder et al. | |
| 6,539,724 | B2 * | 4/2003 | Cornwell et al. | 60/776 |
| 6,640,545 | B2 * | 11/2003 | Ruck et al. | 60/737 |
| 6,702,574 | B1 * | 3/2004 | Dobbeling | 431/350 |
| 6,901,760 | B2 * | 6/2005 | Dittmann et al. | 60/773 |
| 2006/0183069 | A1 * | 8/2006 | Bernero et al. | 431/354 |
| 2007/0042307 | A1 * | 2/2007 | De Marcos et al. | 431/350 |
| 2007/0137208 | A1 * | 6/2007 | Prociw et al. | 60/748 |

FOREIGN PATENT DOCUMENTS

| | | |
|---|---|---|
| EP | 0321809 | 6/1989 |
| EP | 0972987 | 1/2000 |
| EP | 1070915 | 1/2001 |
| WO | WO03036167 | 5/2003 |
| WO | WO2006094922 | 9/2006 |

* cited by examiner

PREMIXING BURNER FOR GENERATING AN IGNITABLE FUEL/AIR MIXTURE

This application is a Continuation of, and claims priority under 35 U.S.C. §120 to, International application number PCT/EP2006/060355, filed 1 Mar. 2006, and claims priority under 35 U.S.C. §119 therethrough to Swiss application number 00407/05, filed 9, Mar. 2005, the entireties of which are incorporated by reference herein.

BACKGROUND OF THE INVENTION

1. Field of the Invention

The invention relates to a premixing burner for generating an ignitable fuel/air mixture, with a swirl generator which provides at least two burner shells which complement one another to form a throughflow body and which jointly enclose an axially conically widening swirl space and delimit with respect to one another, in the axial longitudinal extent of the cone, tangential air inlet slits, through which combustion supply air passes into the swirl space in which an axially propagating swirl flow is formed, and with means for the injection of fuel, with are provided at least partially along the tangentially running air inlet slits.

2. Brief Description of the Related Art

Premixing burners of the abovementioned generic type are known from a multiplicity of previous publications, such as, for example, EP 0 210 462 A1 and EP 0 321 809 B1, to name only a few. Premixing burners of this type are based on the general active principle of generating, within a mostly conically designed swirl generator providing at least two part conical shells assembled with a correspondingly mutual overlap, a swirl flow of a fuel/air mixture and which is ignited within a combustion chamber following the premixing burner in the flow direction, so as to form a premixing flame which is spatially as stable as possible.

For swirl generation, the part conical shells overlapping with one another enclose, along the burner axis, tangential air inlet slits, through which air passes radially into the swirl space delimited by the part conical shells, so as to impart a swirl flow propagating along the burner axis. The part conical shells, mostly with double-walled design, provide for the supply of fuel, in the region along the air inlet slits, at least one internal fuel supply duct, through which is supplied in each case gaseous fuel which emerges via fuel nozzle orifices into the region of the air inlet slits. For this purpose, the fuel orifices are provided, distributed, in the region of the burner shell wall facing the air inlet slit, in order thereby, even in the region of the air inlet slit, to ensure effective intermixing, as uniform as possible, between the gaseous fuel and the inflowing supply air.

In addition to the double-walled design of the part conical shells delimiting the swirl space, it is also known to use part conical shells which are themselves formed simply from single-walled flat materials for air deflection. Premixing burners of this type provide in each case, along the onflow edge of the part conical shells, an attachment in the form of a pipeline, through which gaseous fuel is fed into the combustion supply air along the tangential extent of the air inlet slit through bores provided correspondingly in the pipeline. For this purpose, the pipeline is connected fixedly to the onflow edge of the part conical shell in the manner of a soldered or welded joint.

For reasons of operating reliability which must always be ensured, the supply of gaseous fuel for further feed along the fuel orifices into the area of the air inlet slits normally takes place at gas temperatures in range of between 20° C. and 30° C. On the other hand, as a consequence of operation, temperatures of between 300° C. and 350° C. prevail on account of the radiation temperatures prevailing in the region of the air inlet slits. It is clear that all those part conical shell surfaces delimiting the air inlet regions have body temperatures in the range of the above radiation temperatures. On the other hand, the part conical shell regions are cooled directly around the fuel orifices by the cool gas stream. Owing to these temperature differences, high thermal gradients occur in the region of the fuel orifices and lead to cracks within the material regions surrounding the fuel orifices. This results in irreversible structural weakenings which may possibly lead to a total loss of at least the affected part conical shell. Moreover, the risk of local flashbacks into the duct regions of the fuel supply increases in cracked fuel orifices, and, as a consequence, even the operating reliability of a premixing burner weakened in this way is ultimately called into question.

SUMMARY

One of numerous aspects of the present invention includes developing a premixing burner for generating an ignitable fuel/air mixture, with a swirl generator which provides at least two burner shells which complement one another to form a throughflow body and which jointly enclose an axially conically widening swirl space and delimit with respect to one another, in the axial longitudinal extent of the cone, tangential air inlet slits through which combustion supply air passes into the swirl space in which an axially propagating swirl flow is formed, and with means for the injection of fuel, which are provided at least partially along the tangentially running air inlet slits, in such a way that the means for the injection of fuel along the air inlet slits do not experience any thermally induced crack formations as a consequence of operation.

Features advantageously developing principles of the present invention may be gathered from the description, particularly with reference to the exemplary embodiments.

According to another aspect of the present invention, a premixing burner is developed in such a way that the means for injection of fuel is designed as a fuel line which is separate from the burner shell and which is firmly attached to the burner shell so as to be longitudinally movable along the burner shell and so as to be releasable perpendicularly to the surface of the burner shell. In the burner shell, bores are provided, into which issue fuel injectors which are provided along the fuel line and which project beyond the circumferential edge of the fuel line.

One of numerous principles of the present invention involves designing the means necessary for the injection of gaseous fuel along the air inlet slit as separate structural parts, preferably as one separate structural part, and to mount them spatially in relation to the burner shell so that thermal gradients within the material can be avoided. In particular, it is appropriate to form and fasten those components in which the comparatively cool burner gas is guided separately from the burner shells which, because of the direct exposure to radiation in the area of the flow space, are heated to correspondingly high temperatures. Owing to the component separation, thermal stresses within the burner shells are avoided, with the result that material cracks and associated problems and risks can be ruled out.

At the same time, it is appropriate to ensure that the means required for the supply of fuel and for feeding the fuel into the region of the air inlet slits are connected to the burner shells in such a way that, on the one hand, it is ensured that the means are attached to the burner shells in a operationally reliable way, but on the other hand, the means are mounted movably with respect to the burner shell, in order to tolerate thermally induced material expansion.

For this purpose, the fuel line provided for the supply of fuel to each individual burner shell is designed in the manner of a line pipe closed off on both sides and has a pipe length which is adapted to the axial extent of the respective burner shell and does not project beyond the latter. The fuel line assigned to each individual burner shell is connected by at least one holding means to the burner shell surface facing away from the swirl space, in such a way that the fuel line is largely fixed perpendicularly to the burner shell surface under the action of tension force, but is preferably attached at a distance from the burner shell surface by means of a separating gap and is mounted so as to be largely freely movable in axial extent with respect to the burner shell.

By virtue of this mounting, it is possible that the fuel line can expand independently of the burner shell, so that no thermally induced stresses of any kind can arise between the fuel line and the burner shell, that is to say complete independence prevails in terms of the capacity for thermal expansion between the fuel line and the burner shell which, as an aerodynamic structure, it is responsible for guiding the flow within the burner.

Fuel injectors, as they are known, issue from the fuel line oriented in axial extent in relation to the burner shell and at least partially project through orifices or bores provided within the burner shell. In a preferred embodiment, the fuel injectors are designed as sleeve elements which in each case have one hollow duct and which have at most an elevation which projects beyond the circumferential edge of the fuel line and by means of which they are joined, flush, to that surface of the burner shell facing away from the fuel line. As a result, only a narrow annular foremost edge of a fuel injector is exposed to the temperatures prevailing within the air inlet slit, and therefore each individual fuel injector is heated only insignificantly or negligibly. Essentially, both the fuel line and fuel injectors required for feeding the gaseous fuel into the air inlet slit remain at the low temperature level predetermined by the gaseous fuel stream. Thermally induced stresses due to thermal gradients which occur are therefore ruled out virtually completely.

Nevertheless, a further fastening of the fuel line assigned to each individual burner shell is required, especially since it is appropriate to prevent the fuel line from falling off from the respective burner shell during the normal burner operation. For this purpose, each individual fuel line is provided with a connecting web, via which the fuel line is connected firmly to a component of the premixing burner which is not part of the burner shell. Preferably, for this purpose, a suitable carrying structure is a molded element which surrounds all the burner shells at the downstream end region of the swirl generator and which, favorably in terms of flow, transfers the swirl flow forming in the swirl generator axially downstream to a combustion chamber or into a mixing zone provided between the combustion chamber and swirl generator.

In a particularly advantageous way, the connecting web is not attached directly to the fuel line running parallel to the longitudinal extent of the burner shell, but the fuel line provides a connecting flange, to which a fuel supply line can be connected in a fluid-tight manner and to which, furthermore, the connecting web is attached. The connecting web is optimized in length and shape to the effect that the fuel line is mounted with respect to the burner shell so as to have as little vibration as possible, and, moreover, it is appropriate, as far as possible, not to transmit the burner vibrations originating from the burner to the fuel line along the connecting web. For this purpose, the cross section of the connecting web is designed along its extent with variable cross-sectional shapes, for example elliptic cross-sectional shapes are highly suitable for a controlled suppression of vibration modes occurring in the burner.

For a further description, reference is made to the exemplary embodiment described in more detail in the figures.

BRIEF DESCRIPTION OF THE DRAWINGS

The invention is described below, by way of example, without the general idea of the invention being restricted, by means of exemplary embodiments, with reference to the drawings in which.

DETAILED DESCRIPTION OF EXEMPLARY EMBODIMENTS

Figure 1:
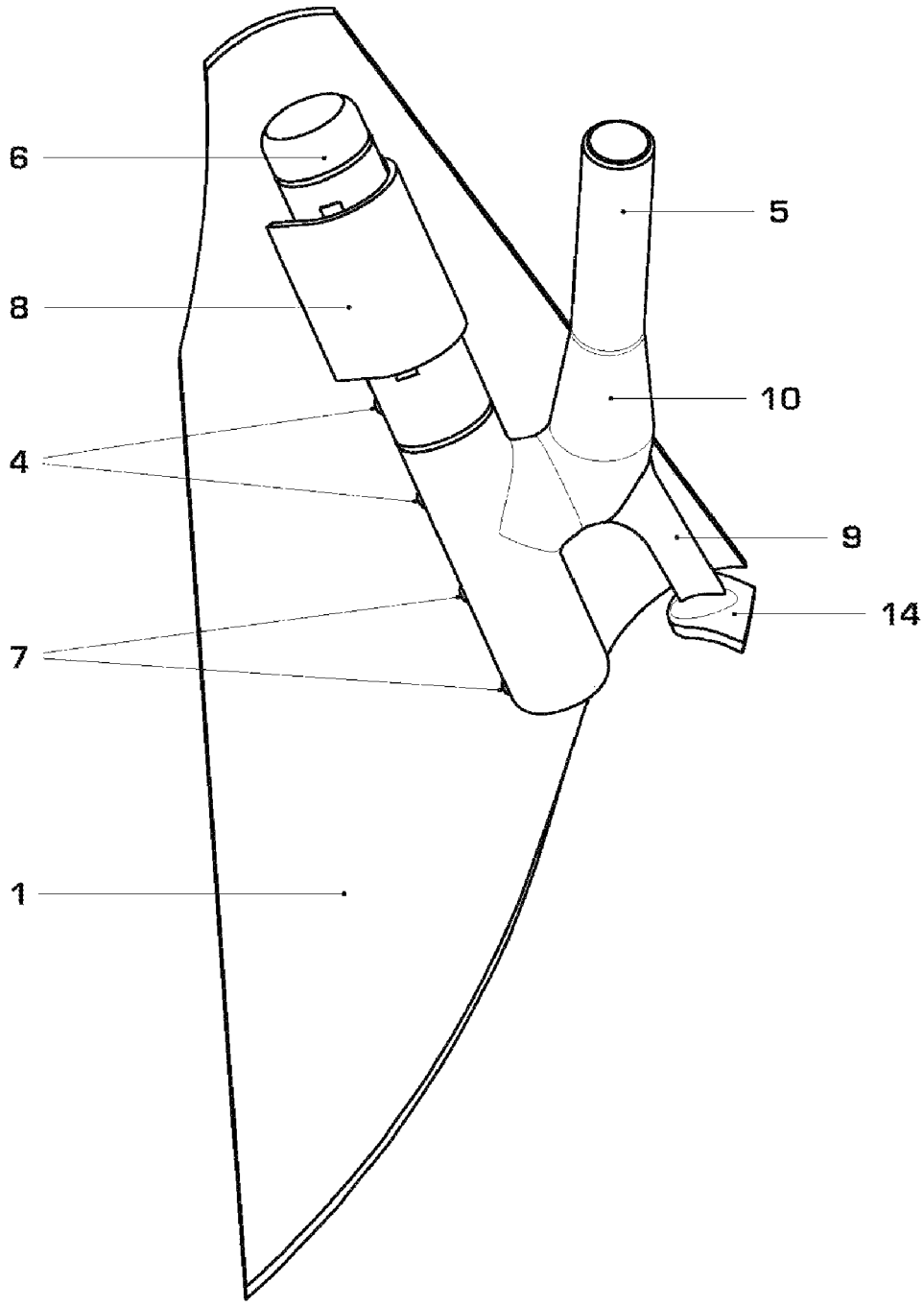
FIG. 1 shows a three-dimensional illustration of a burner shell with a fuel line attached according to the solution.

FIG. 1 is a three-dimensional illustration of a single burner shell 1, of which the top side facing away from the swirl space faces the observer so as to be visible.

Figure 2:
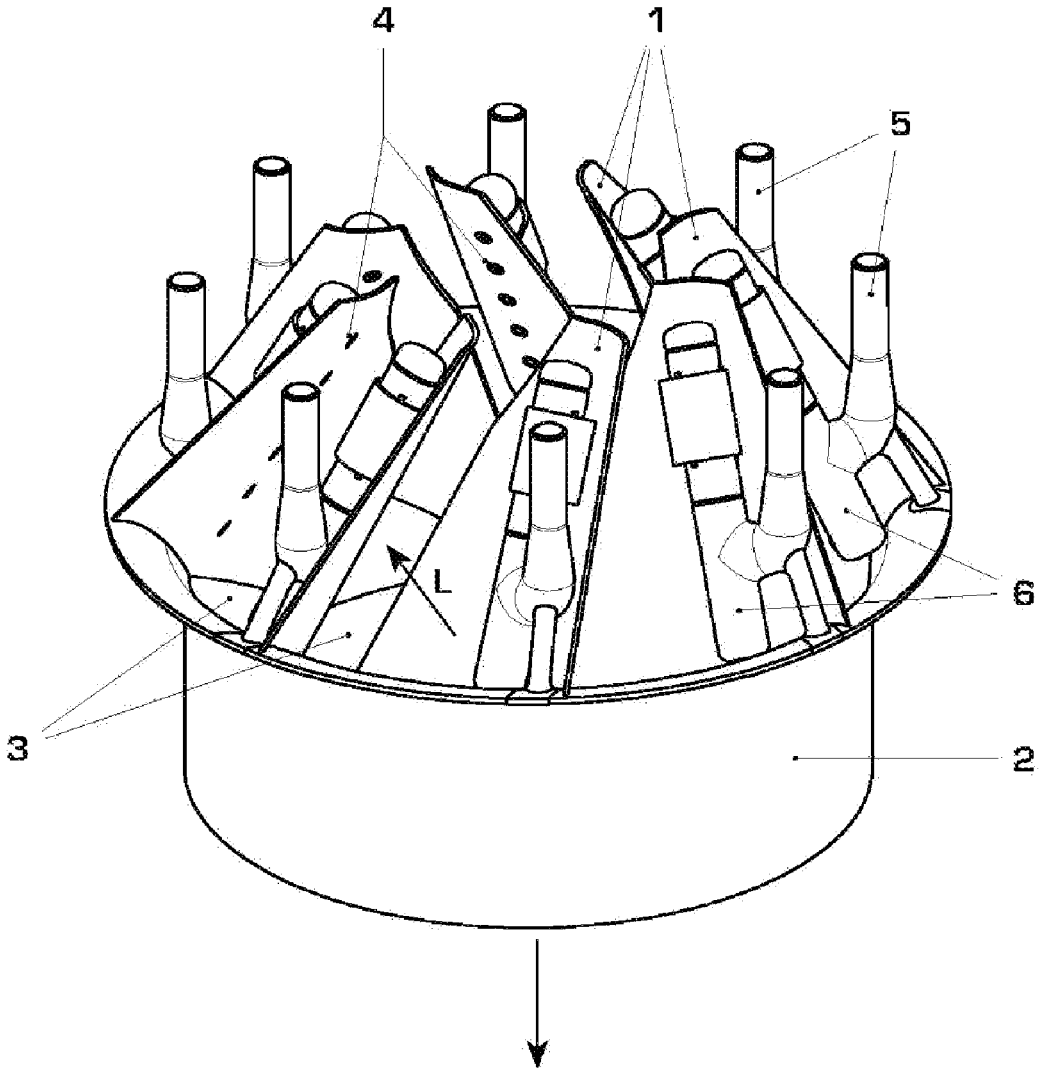
FIG. 2 shows a three-dimensional crown-shaped arrangement of a multiplicity of burner shells around an entry geometry of a premixing burner.

To make it easy to understand the spatial arrangement and type of functioning of the burner shell illustrated in FIG. 1, reference may made, furthermore, to the swirl generator, shown in FIG. 2, of a premixing burner which provides eight individual burner shells 1 which are arranged in the form of a crown around a molded element 2 and internally enclose with respect to one another in each case a conically widening swirl space. For the sake of greater clarity, a holding ring which is to be provided for the stability of the burner shells 1 and which centrally supports the upper ends of the burner shells in the illustration is not illustrated, especially since this is not of any further importance for explaining the subject matter of this application.

For the technical understanding of the burner shell arrangement illustrated in FIG. 2, it may be noted that in each case two burner shells 1, arranged directly adjacently, jointly enclose an air inlet slit 3, through which in each case a supply air stream L flows in the radial flow direction into the internal swirl space delimited by the burner shells 1. The swirl flow forming in the swirl space emerges from the swirl generator illustrated in FIG. 2 downward (see the illustrated arrow). To form an ignitable fuel/air mixture, gaseous fuel is admixed in a way known per se to the inflowing combustion supply air L in the region of the air inlet slit 3. This takes place through orifices 4 which are located within the burner shells 1 and which are arranged in each case in the axial extent of each individual burner shell, preferably along a straight line.

Fuel supply takes place, in the case of each individual burner shell, via the fuel supply line 5 (see FIGS. 1 and 2) which is connected to a fuel line 6 of pipe-like design. The fuel line 6 of the pipe-like design is designed so as to be closed at each of its two pipe ends and is arranged as a separate component with respect to the burner shell 1. As may be gathered further, particularly with reference to FIGS. 3 and 4, the pipeline 6 provides fuel injectors 7 of sleeve-like design which at least partially issue, facing the burner shell 1, into or through the orifices 4 provided in the burner shell 1.

To fasten the fuel line 6 of pipe-like design to the burner shell 1, a holding device 8 is provided, which fixes the fuel line 6 radially, that is to say perpendicularly to the surface of the burner shell 1, under the action of tension force and which ensures that the fuel injectors 7 projecting into the orifices 4 within the burner shell 1 remain reliably in the orifices and cannot "slip out". On the other hand, the holding device 8, when designed as a holding clip, affords the possibility that the fuel line 6 can at least slightly execute relative movements along its longitudinal axis, that is to say axially with respect to the burner shell, in order thereby to prevent any distortion phenomena and jams between the fuel line 6 and the burner shell 1 on account of a different thermal expansion behavior.

The holding device 8 designed as a holding clip has a shape adapted correspondingly to the outer contour of the pipeline 6, in the case of a cylindrically designed fuel line 6, the holding device has a U-shaped design and is connected with both U-legs to the top side of the burner shell 1. The connection between the holding device 8 and the burner shell 1 takes place either according to a fixed connection, for example a soldered or welded joint, or by a releasably formed connection whereby simplified mounting and demounting of the burner components are possible.

For further fastening, the fuel line 6 is firmly connected via a connecting web 9 to the entry geometry of the molded element 2 (see FIG. 2). The connecting web 9 issues into a connecting flange 10 which is connected firmly to the fuel line 6 and which makes a gas-tight connection between the fuel line 6 and supply line 5.

Figure 3:
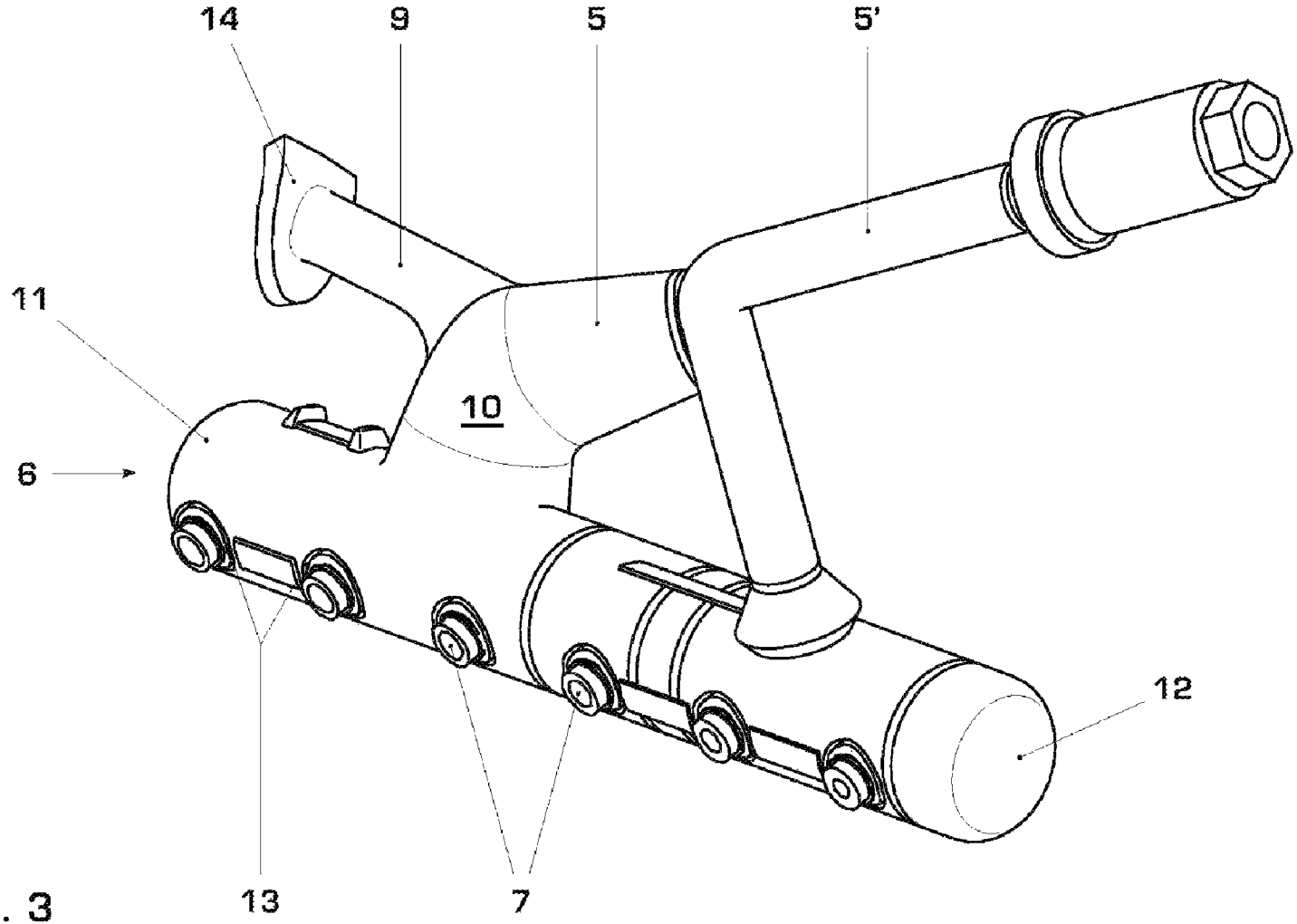
FIG. 3 shows a perspective illustration of a burner line.

FIG. 3 illustrates a diagrammatic perspective illustration of the fuel line 6 as a separate structural part. The fuel line 6, of pipe-shaped design, which is closed off, gas-tight, at the two opposite end regions 11, 12, has, in a linear arrangement along its axial extent, orifices 13 in which the fuel injectors 7, as they are known, are integrated.

The fuel injectors 7 of sleeve-like design in each case project beyond the circumferential edge of the fuel line 6 of pipe-shaped design, so that they at least partially issue into the orifices, not illustrated in FIG. 3, within the burner shell 1. In the exemplary embodiment illustrated in FIG. 3, two separate fuel supply lines 5, 5' are provided, via which gaseous fuel is supplied to the fuel line 6 from two different fuel supply circuits. In principle, however, it is possible to connect the fuel line 6 to only a single supply line. The flanging piece 10 connected directly to the fuel line has attached to it the connecting web 9 which provides a fastening foot 14, at which the separate structural unit is firmly attached to the entry geometry of the molded element 2, preferably in the manner of a soldered or welded joint.

Figure 4:
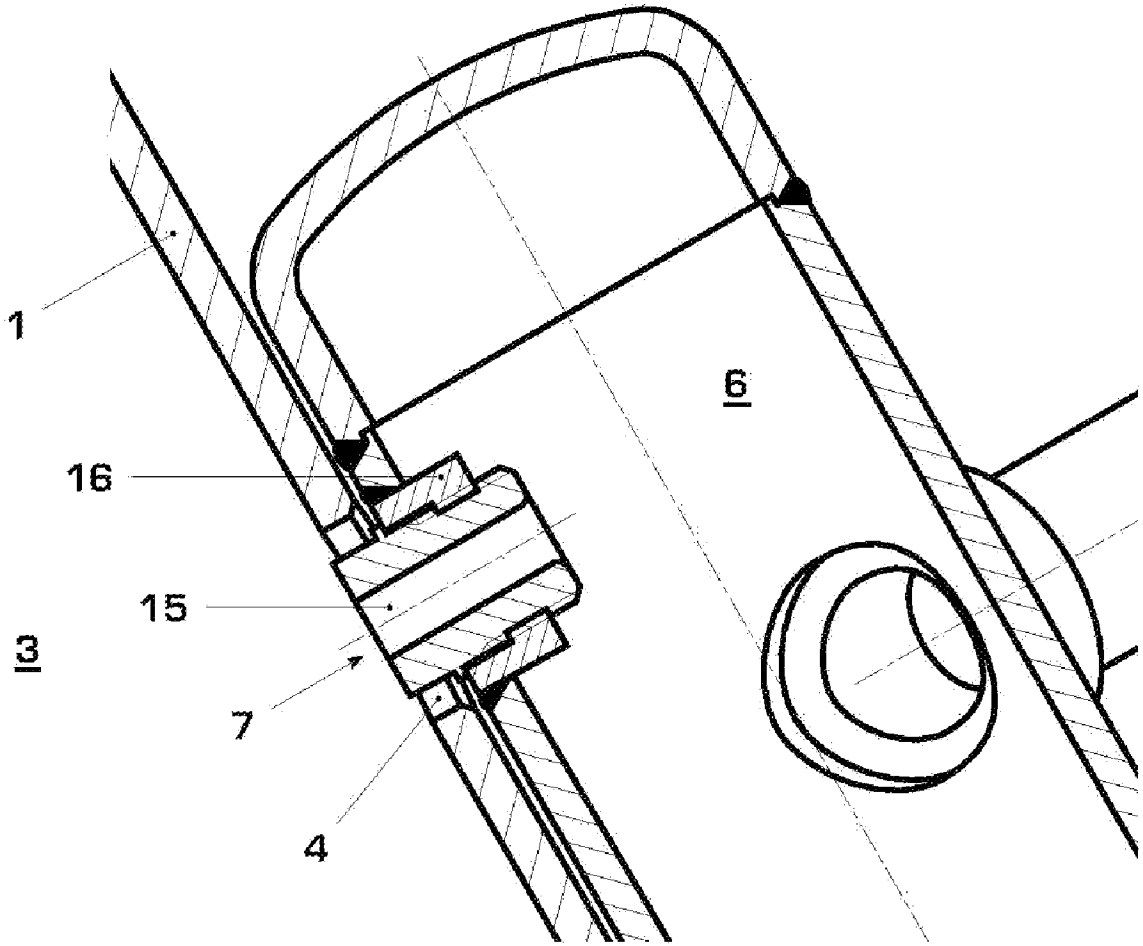
FIG. 4 shows an illustration of a detail of a fuel orifice introduced in a burner shell.

FIG. 4 shows a partial cross-sectional illustration through the fuel line 6 in the region of a fuel injector 7 which issues into the orifice 4 of a burner shell 1. The fuel injector 7 is of sleeve-like design and has an internal hollow duct 15, through which gaseous fuel is injected from inside the fuel line 6 into the air inlet gap 3 delimited by two adjacent burner shells. To ensure a largely thermal decoupling between the burner shell 1 and the fuel line 6, the circumferential edge of the fuel line 6 is arranged so as to be spaced apart from the top side, facing the fuel line 6, of the burner shell 1. This may take place either by the provision of an air gap between the two components, which is ensured by spacer elements, not illustrated, between the fuel line 6 and burner shell 1, or by a thermally non-conducting or poorly conducting intermediate layer to be suitably provided.

So that relative axial motion between the fuel line 6 and burner shell 1 can be ensured according to the arrow illustrated in FIG. 4, the orifices provided within the burner shell 1 are designed with a slight oversize with respect to the diameter of the fuel injectors, so that a marked air gap is established between the outer circumferential edge of the respective fuel injector 7 and the orifice 4. In a preferred embodiment, the orifices 4 introduced within the burner shell 1 are designed as slots or long holes oriented in the axial extent of the burner shell, in order, in particular, to allow that region of the fuel line 6 located furthest away from the connecting web 9 to have the greatest possibility for relative longitudinal expansion. It may also be gathered from the partial cross-sectional illustration according to FIG. 4 that the fuel injector 7, designed as a sleeve element, is connected to the pipeline wall via at least one intermediate element 16, in order to keep as low as possible any heating possibly acting on the fuel line 6 via the sleeve element of the fuel injector 14.

By virtue of the separate design of the fuel line 6 and its above-described mounting with respect to the burner shell 1, any thermal stresses between the two components can largely be ruled out, and, in particular, the associated risk of possible crack formation in the material of the burner shell in the region of the fuel orifices can be avoided.

LIST OF REFERENCE SYMBOLS

1 Burner shell
2 Molded element
3 Air inlet gap
4 Orifice within the burner shell
5, 5' Supply line
6 Fuel line
7 Fuel injector
8 Holding device
9 Connecting web
10 Connecting flange
11, 12 End regions of the fuel line 6
13 Orifice within the fuel line
14 Fastening foot
15 Hollow duct
16 Intermediate piece While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A premixing burner for generating an ignitable fuel/air mixture, comprising:

a swirl generator having at least two burner shells which complement one another to form a throughflow body and which jointly enclose an axially conically widening swirl space and delimit, with respect to one another in the axial longitudinal extent of the cone, tangential air inlet slits through which combustion supply air can pass into the swirl space in which an axially propagating swirl flow can be formed and means for the injection of fuel, said fuel injection means positioned at least partially along the tangentially running air inlet slits, the fuel injection means comprising a fuel line separate from the at least two burner shells and firmly attached to at least one of the at least two burner shells so as to be longitudinally movable with respect to said at least one burner shell and so as to be releasable perpendicularly to the surface of the burner shell;

fuel injectors along the fuel line and projecting beyond a circumferential edge of the fuel line; and orifices in said at least one burner shell, the fuel injectors extending into the orifices;

wherein at least some of the orifices comprise slots, each slot having a largest dimension which is parallel to the longitudinal direction of the fuel line and wherein the fuel line is attached to the at least one of the two burner shells independently of the fuel injectors.

2. The premixing burner as claimed in claim 1, wherein said at least one burner shell includes a surface which faces the fuel line, and further comprising:

a holding device along the burner shell connected to said at least one burner shell and which fixes the fuel line while applying a prestress directed perpendicularly to said surface of the at least one burner shell.

3. The premixing burner as claimed in claim 1, wherein said at least one burner shell includes a surface which faces the fuel line, the fuel line includes a circumferential edge, and further comprising:

spacer elements between the surface of the at least one burner shell and the circumferential edge of the fuel line, the spacer elements defining an air gap between said surface of the at least one burner shell and the fuel line.

4. The premixing burner as claimed in claim 1, further comprising:

a component which is not part of a burner shell; and wherein the fuel line comprises a connecting web via which the fuel line is firmly connected to said component.

5. The premixing burner as claimed in claim 1, wherein the fuel line has a circumferential edge;

wherein the fuel injectors comprise sleeve elements which each have a hollow duct and which each have at most an elevation which projects beyond the circumferential edge of the fuel line, the fuel injectors joined flush to a surface of the at least one burner shell which faces away from the fuel line with the sleeve elements.

6. The premixing burner as claimed in claim 2, wherein the holding device is releasably connected to said at least one burner shell.

7. The premixing burner as claimed in claim 4, further comprising:

a molded element surrounding the at least two burner shells, the molded element positioned at a downstream end region of the swirl generator, the connecting web of the fuel line fastened to the molded element.

* * * * *